US007926932B2

(12) United States Patent
Kubota et al.

(10) Patent No.: US 7,926,932 B2
(45) Date of Patent: Apr. 19, 2011

(54) IMAGE FORMING APPARATUS AND PRINTING CONTROL METHOD

(75) Inventors: Atsushi Kubota, Sunto-gun (JP); Masashi Hiroki, Yokohama (JP); Satoshi Kaiho, Yokohama (JP); Takashi Kado, Izunokuni (JP); Kazuhiko Ohtsu, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 410 days.

(21) Appl. No.: 12/235,633

(22) Filed: Sep. 23, 2008

(65) Prior Publication Data

US 2009/0085954 A1 Apr. 2, 2009

Related U.S. Application Data

(60) Provisional application No. 60/976,136, filed on Sep. 28, 2007.

(51) Int. Cl.

| | |
|---|---|
| ***B41J 2/01*** | (2006.01) |
| ***B41J 29/38*** | (2006.01) |
| ***B41J 29/393*** | (2006.01) |

(52) U.S. Cl. ..... 347/102; 347/16; 347/19

(58) Field of Classification Search ..... 347/16, 347/19, 102

See application file for complete search history.

(56) References Cited

FOREIGN PATENT DOCUMENTS

| | | |
|---|---|---|
| JP | 08-052869 | 2/1996 |
| JP | 2002-337319 | 11/2002 |

*Primary Examiner* — Julian D Huffman

(74) *Attorney, Agent, or Firm* — Turocy & Watson, LLP

(57) ABSTRACT

An image forming apparatus includes a conveying path that continues to a paper feeding unit and a paper discharge unit, a conveying mechanism that conveys a sheet along the conveying path, plural liquid ejecting heads that eject liquid onto the sheet conveyed on the conveying path, a sensor that is provided in a position between the plural liquid ejecting heads and the paper discharge unit and measures the glossiness of the sheet on which the liquid is ejected, and a control mechanism that compares the glossiness of the sheet immediately after the liquid is ejected and the glossiness measured by the sensor to calculate drying time of the liquid and controls conveying speed of the conveying mechanism to equalize conveying time for the sheet from the plural liquid ejecting heads to the paper discharge unit with the drying time.

20 Claims, 3 Drawing Sheets

IMAGE FORMING APPARATUS AND PRINTING CONTROL METHOD

CROSS-REFERENCE TO RELATED APPLICATION

This application claims the benefit of U.S. Provisional Application No. 60/976,136, filed on Sep. 28, 2007.

TECHNICAL FIELD

The present invention relates to an image forming apparatus and a printing control method in which a smear on a sheet is prevented.

BACKGROUND

JP-A-2002-337319 discloses an inkjet recording apparatus in which a so-called smear on a sheet is prevented. The inkjet recording apparatus includes an inkjet head, a discharging unit that discharges a sheet to a discharge position, a period determining unit that determines a period until the sheet comes into contact with the preceding sheet, and a speed controlling unit that controls speed of recording on the sheet.

In the inkjet recording apparatus, the period determining unit measures a recording ratio on the sheet and determines time when the conveyance of the sheet is stopped. The speed controlling unit stops a recording operation for a following sheet until the drying of the sheet is completed and resumes the recording operation after the drying is completed. This prevents a "smear" caused when the following sheet comes into contact with and rubs against the preceding sheet while ink does not completely dry.

However, time necessary for the drying of the sheet is determined assuming a worst condition among assumed environments of use, i.e., assuming a high humidity environment. Therefore, in an actual environment of use, drying time longer than necessary is secured. When the recording operation is stopped throughout the drying time, long time is required until the completion of printing. Therefore, there is room for improvement.

JP-A-8-52869 discloses a recording apparatus that determines, according to the reflectance on the surface of recording paper, whether the drying of ink is performed. The recording apparatus includes a recording head, a conveying unit that conveys the recording paper, a surface-state discriminating unit that discriminates a surface state of the recording paper, and a controlling unit that controls the conveying unit on the basis of a result of the discrimination by the surface-state discriminating unit.

The recording apparatus prints a black mark near the trailing end of the recording paper. The conveying unit moves the recording paper to below the surface-state discriminating unit. The surface-state discriminating unit measures the reflectance of the recording paper. When reflected light is outputted, the recording apparatus determines that the ink is not dried and stops the recording operation. When the output of the reflected light ends and it is determined that the ink is dried, the recording apparatus conveys the recording paper again, discharges the recording paper, and finishes the recording.

In the recording apparatus, since the black mark is printed last at the trailing end of the recording paper, the black mark dries latest in the recording paper. Therefore, the recording operation may be stopped regardless of the fact that the recording paper is actually dried. In this regard, there is room for improvement. Further, it is necessary to always print the black mark at the trailing end of the recording paper and the finish of the recording paper is deteriorated. In this regard, there is also room for improvement.

SUMMARY

It is an object of the present invention to obtain an image forming apparatus that can prevent a smear on a sheet with a simple configuration.

In order to attain the object, an image forming apparatus according to an aspect of the present invention includes a conveying path that continues to a paper feeding unit and a paper discharge unit for a sheet, a conveying mechanism that conveys the sheet along the conveying path, plural liquid ejecting heads that eject liquid onto the sheet conveyed on the conveying path, a sensor that is provided in a position between the plural liquid ejecting heads and the paper discharge unit and measures the glossiness of the sheet on which the liquid is ejected, and a control mechanism that compares the glossiness of the sheet immediately after the liquid is ejected and the glossiness measured by the sensor to calculate drying time of the liquid and controls conveying speed of the conveying mechanism to equalize conveying time for the sheet from the plural liquid ejecting heads to the paper discharge unit with the drying time.

In order to attain the object, an image forming apparatus according to another aspect of the present invention includes a conveying path that continues to a paper feeding unit and a paper discharge unit for a sheet, a conveying unit that conveys the sheet along the conveying path, plural liquid ejecting units that eject liquid onto the sheet conveyed on the conveying path, a measuring unit that is provided in a position between the plural liquid ejecting units and the paper discharge unit and measures the glossiness of the sheet on which the liquid is ejected, and a control unit that compares the glossiness of the sheet immediately after the liquid is ejected and the glossiness measured by the measuring unit to calculate drying time of the liquid and controls conveying speed of the conveying unit to equalize conveying time for the sheet from the plural liquid ejecting units to the paper discharge unit with the drying time.

In order to attain the object, a printing control method according to still another aspect of the present invention includes ejecting liquid onto a sheet using plural liquid ejecting units, conveying the sheet, on which the liquid is ejected, to a paper discharge unit using a conveying unit, measuring the glossiness of the sheet conveyed by the conveying unit using a measuring unit, and comparing the glossiness and the glossiness of the sheet immediately after the liquid is ejected to calculate drying time of the liquid and controlling the conveying unit using a control unit to equalize conveying time for the sheet from the liquid ejecting unit to the paper discharge unit with the drying time.

According to the present invention, it is possible to obtain an image forming apparatus that can prevent a smear on a sheet with a simple configuration.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION

An image forming apparatus according to the present invention is explained below with reference to the accompanying drawings. The image forming apparatus can eject liquid onto a sheet and form characters and images on the sheet.

Figure 1:
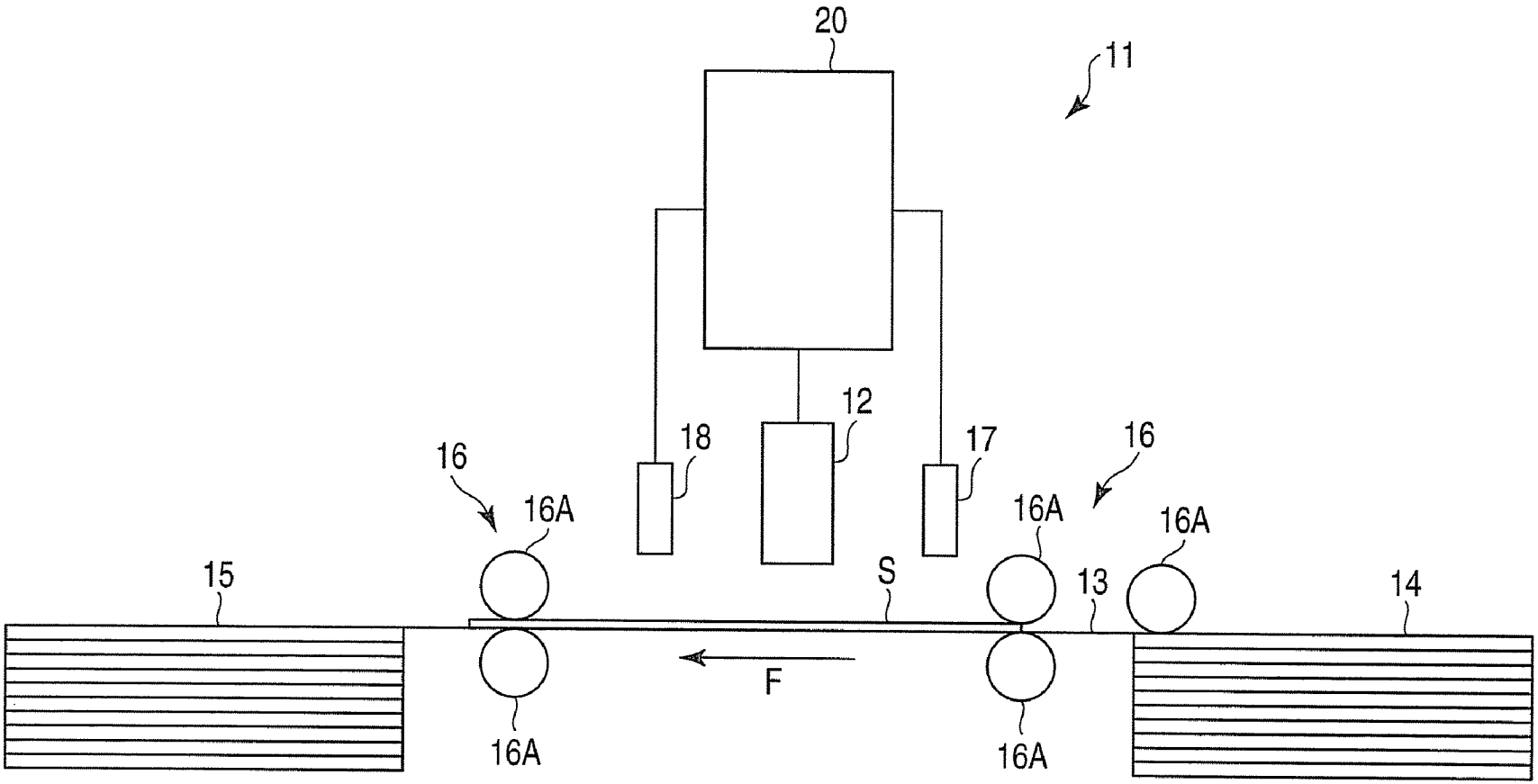
FIG. 1 is a schematic side view showing an image forming apparatus according to a first embodiment of the present invention.
Figure 2:
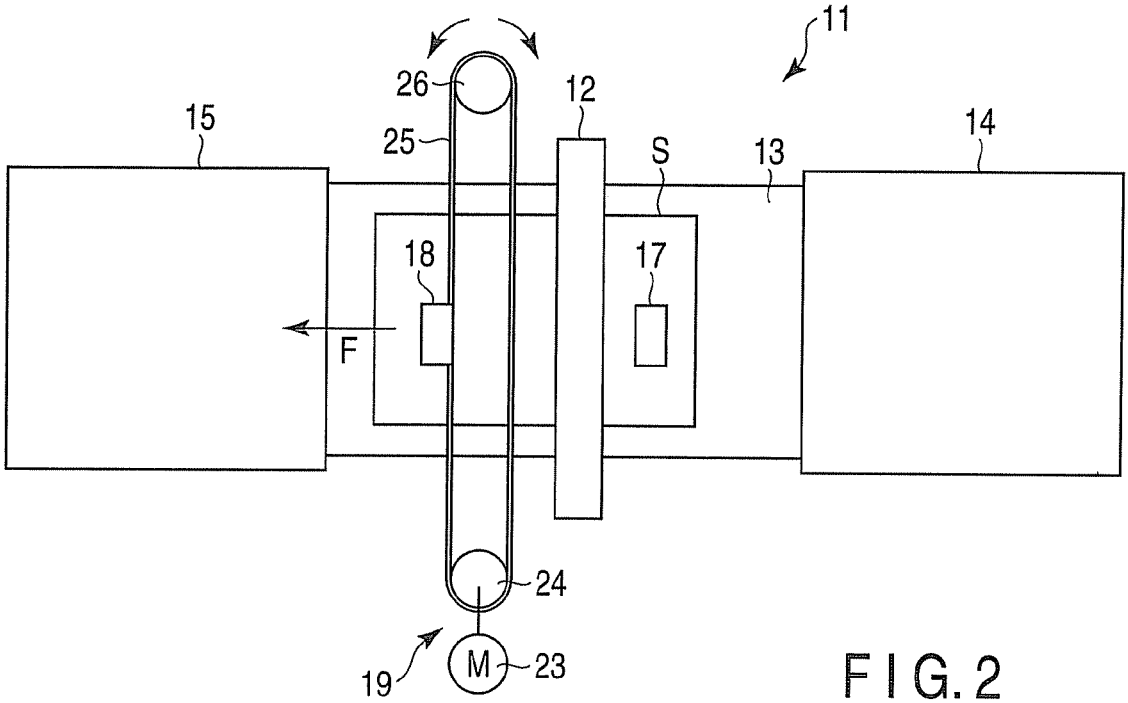
FIG. 2 is a schematic top view of the image forming apparatus shown in FIG. 1 viewed from above.

As shown in FIGS. 1 and 2, an image forming apparatus 11 includes an inkjet head 12 as an example of a liquid ejecting head (a liquid ejecting unit) that ejects liquid droplets onto a sheet S, a conveying path 13 on which the sheet S is conveyed, a paper feeding unit 14 that feeds the sheet S to the conveying path 13, a paper discharge unit 15 that collects the sheet S having an image formed thereon from the conveying path 13, a conveying mechanism 16 as a conveying unit that conveys the sheet S in a conveying direction F on the conveying path 13, a first sensor 17 and a second sensor 18 that detect the glossiness of the sheet S conveyed on the conveying path 13, a moving mechanism 19 that moves the second sensor 18 in a width direction of the conveying path 13, and a control mechanism 20 as a control unit that collectively controls these units. The conveying path 13 continues to the paper feeding unit 14 and the paper discharge unit 15.

The inkjet head 12 can eject liquid droplets, i.e., ink droplets onto the sheet S conveyed by the conveying mechanism 16. As shown in FIG. 2, the inkjet head 12 is a so-called line head extending over the entire width direction of the conveying path 13. The inkjet head 12 has not-shown plural nozzles for ejecting ink. The inkjet head 12 has, for example, a piezoelectric element made of PZT (lead zirconate titanate) that functions as a driving element. When voltage is applied to the piezoelectric element, the piezoelectric element is deformed and increases the pressure in the inside of a pressure chamber corresponding to the nozzles. Consequently, liquid droplets are ejected from the nozzles to the sheet S.

As shown in FIG. 1, the conveying mechanism 16 has plural driving rollers 16A for conveying the sheet S along a conveying direction F. The control mechanism 20 includes, for example, a CPU, a ROM, a RAM, and an internal bus for connecting these devices and has a computer function for controlling the respective units of the image forming apparatus 11.

The first sensor 17 and the second sensor 18 are optical sensors and can measure the glossiness (reflectance) on the surface of a sheet. The first sensor 17 is provided to be opposed to the conveying path 13 in a position between the paper feeding unit 14 and the inkjet head 12. The second sensor 18 is provided to be opposed to the conveying path 13 in a position between the paper discharge unit 15 and the inkjet head 12.

The first sensor 17 and the second sensor 18 respectively include light-emitting elements configured by LEDs or the like and light-receiving elements configured by phototransistors or the like.

As shown in FIG. 2, the moving mechanism 19 can move the second sensor 18 in the width direction of the conveying path 13 orthogonal to the conveying direction F in which the sheet S is conveyed. The moving mechanism 19 has a stepping motor 23 serving as a driving source and a first pulley 24, a belt 25, and a second pulley 26 to which the driving force of the stepping motor 23 is transmitted.

As inks ejected from the inkjet head 12, ink of black, ink of yellow, ink of magenta, and ink of cyan are prepared. The black ink has, for example, a composition described below.

| | |
|---|---|
| Self-dispersing carbon black dispersion (Carbon black solid content density) | 8.0 weight % |
| Glycerin | 30.0 weight % |
| Ethylene glycol monobutyl ether | 0.5 weight % |
| Surfynol 465 | 1.0 weight % |
| Proxel XL-2(S) | 0.2 weight % |
| Ion-exchanged water | remaining amount |

The yellow ink has, for example, a composition described below.

| | |
|---|---|
| Self-dispersing yellow dispersion (Yellow pigment solid content density) | 6.0 weight % |
| Glycerin | 45.0 weight % |
| Ethylene glycol monobutyl ether | 5.0 weight % |
| Surfynol 465 | 1.0 weight % |
| Proxel XL-2(S) | 0.2 weight % |
| Ion-exchanged water | remaining amount |

The magenta ink has, for example, a composition described below.

| | |
|---|---|
| Polymeric dispersant dispersing magenta dispersion (Magenta pigment solid content density) | 6.0 weight % |
| Glycerin | 45.0 weight % |
| Diethylene glycol monobutyl ether | 5.0 weight % |
| Surfynol 465 | 1.0 weight % |
| Proxel XL-2(S) | 0.2 weight % |
| Ion-exchanged water | remaining amount |

The cyan ink has, for example, a composition described below.

| | |
|---|---|
| Polymeric dispersant dispersing cyan dispersion (Cyan pigment solid content density) | 6.0 weight % |
| Glycerin | 45.0 weight % |
| Triethylene glycol monobutyl ether | 5.0 weight % |
| Surfynol 465 | 1.0 weight % |
| Proxel XL-2(S) | 0.2 weight % |
| Ion-exchanged water | remaining amount |

Respective steps in forming an image on the sheet S in the image forming apparatus 11 are explained. First, before an image is formed on the sheet S, which is conveyed by the conveying mechanism 16, by the inkjet head 12, the glossiness of the sheet S is measured by the first sensor 17. The glossiness measured by the first sensor 17 is set as a reference value, i.e., a baseline, in measuring glossiness with the following second sensor 18. Subsequently, when the sheet S is conveyed to a position opposed to the inkjet head 12, ink is ejected onto the sheet S from the inkjet head 12. Consequently, an image is formed on the sheet S.

Figure 3:
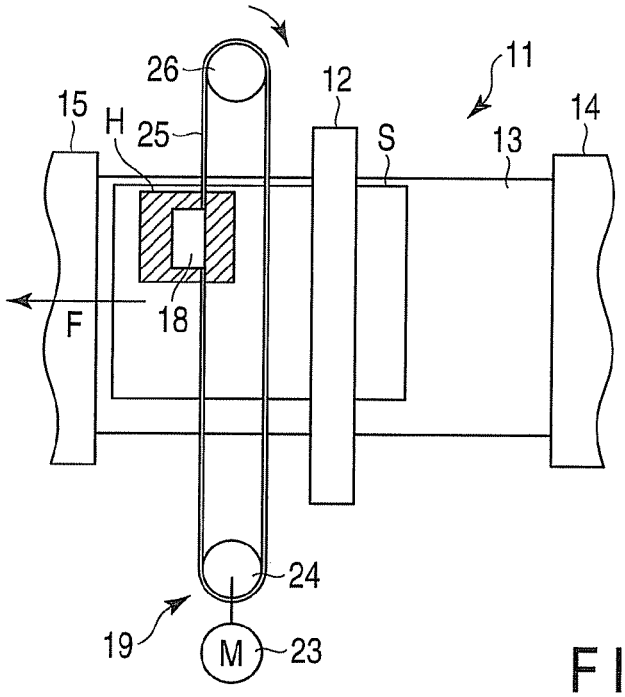
FIG. 3 is a schematic top view showing a state in which a second sensor moves in the image forming apparatus shown in FIG. 2.

When the sheet S is conveyed to a position opposed to the second sensor 18, as shown in FIG. 3, the control mechanism 20 drives the moving mechanism 19 to move the second sensor 18 in synchronization with the conveyance of the sheet S. The moving mechanism 19 moves the second sensor 18 to an area H with high recording density (printing ratio) on the sheet S with the driving force of the stepping motor 23. The control mechanism 20 acquires in advance information concerning the recording density from information concerning an image formed on the sheet S and recognizes the area H with high recording density on the sheet S from this information.

The second sensor 18 measures the glossiness of the area H with high recording density on the sheet S. The glossiness of the sheet S falls as the ink discharged onto the sheet S dries. Therefore, a value of the glossiness of the sheet S falls in proportion to elapsed time. The control mechanism 20 compares the glossiness of the sheet S measured by the second sensor 18 and the glossiness of the sheet S immediately after the ink is ejected, which is measured in advance. The control mechanism 20 calculates a tilt of a straight line indicating the glossiness from a rate of fall in the glossiness according to a principle illustrated in FIG. 4. The control mechanism 20 extends this straight line and calculates time L2 when a value of the glossiness reaches the baseline, i.e., the sheet S completely dries.

Figure 4:
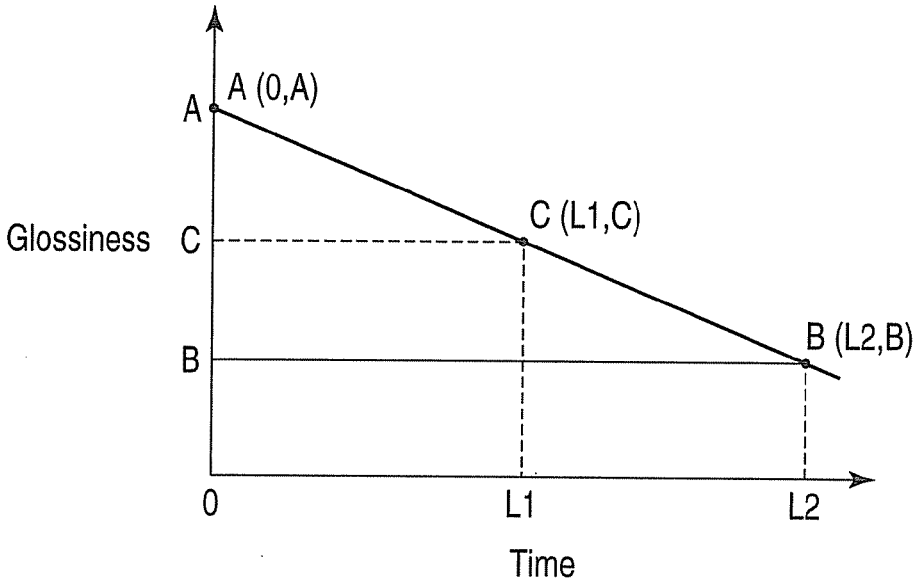
FIG. 4 is a graph illustrating a principle for calculating drying time for a sheet in the image forming apparatus shown in FIG. 1.

A method of calculating the time L2 is specifically explained with reference to FIG. 4. In FIG. 4, time required for conveying the sheet S from the inkjet head 12 to the second sensor 18 is represented as L1, time required for conveying the sheet S from the inkjet head 12 to the paper discharge unit 15 is represented as L2, an output of the glossiness of the sheet S at a point A immediately after ink is ejected is represented as A, an output of the glossiness of the sheet S measured by the second sensor 18 at a point C opposed to the second sensor 18 is represented as C, a position corresponding to the paper discharge unit 15 is represented as a point B, and an output on the baseline of the glossiness of the sheet S measured by the first sensor 17 is represented as B. As a value of A, a value measured in advance is stored by the control mechanism 20 for each of types of the sheet S.

A general formula of a linear function illustrated in FIG. 4 is represented as $$y=ax+b.$$

In this case, a tilt of a straight line connecting A and C is represented as $$a=\frac{C-A}{L1},$$

which can be calculated as a constant according to the measurement of glossiness.

The straight line connecting A and C is represented as $$y=\frac{C-A}{L1}x+A.$$

Here, time when the glossiness falls to be equal to or lower than B (the ink completely dries) at the point B, i.e., L2, is calculated. Therefore, a coordinate B(L2, B) is substituted in the above formula to obtain $$B\leq\frac{C-A}{L1}L2+A.$$

When this formula is solved for L2, the time L2 can be calculated as $$L2\geq\frac{B-A}{C-A}L1.$$

The control mechanism 20 controls sheet conveying speed of the conveying mechanism 16 to equalize time until the sheet S reaches the paper discharge unit 15 from the inkjet head 12 with time until the ink on the sheet S completely dries, i.e., L2. The control mechanism 20 has a timer function. If time when the sheet S reaches the paper discharge unit 15 is too early, the control mechanism 20 sets the conveying speed (printing speed) of the sheet S lower than normal conveying speed to adjust the time when the sheet S reaches the paper discharge unit 15. According to such control, the ink on the sheet S completely dries when the sheet S reaches the paper discharge unit 15. Therefore, even when the sheet S is placed on other sheets in the paper discharge unit 15, the other sheets are prevented from being smeared by the ink of the sheet S.

According to this embodiment, the image forming apparatus 11 includes the conveying path 13 that continues to the paper feeding unit 14 and the paper discharge unit 15, the conveying mechanism 16 that conveys the sheet S along the conveying path 13, the plural liquid ejecting heads that eject liquid onto the sheet S conveyed on the conveying path 13, the sensor that is provided in a position between the plural liquid ejecting heads and the paper discharge unit 15 and measures the glossiness of the sheet S on which the liquid is ejected, and the control mechanism 20 that compares the glossiness of the sheet S immediately after the liquid is ejected and the glossiness measured by the sensor to calculate drying time of the liquid and controls the conveying speed of the conveying mechanism 16 to equalize conveying time for the sheet S from the plural liquid ejecting heads to the paper discharge unit 15 with the drying time.

In the printing control method according to this embodiment, liquid is ejected onto the sheet S by plural paper ejecting units, the sheet S on which the liquid is ejected is conveyed to the paper discharge unit 15 by the conveying unit, the glossiness of the sheet S conveyed by the conveying unit is measured by the measuring unit, the glossiness and the glossiness of the sheet S immediately after the liquid is ejected are compared by the control unit to calculate drying time of the liquid, and the conveying unit is controlled to equalize conveying time for the sheet S from the liquid ejecting units to the paper discharge unit 15 with the drying time.

With these configurations, the control mechanism 20 (the control unit) predicts, from a rate of change in the glossiness, time for the ink on the sheet S to dry. Therefore, the sheet S is discharged to the paper discharge unit in a state in which the ink on the sheet S is completely dried. Other sheets in the paper discharge unit 15 are prevented from being smeared by the wet ink on the sheet S. Time for conveying the sheet S from the liquid ejecting heads to the paper discharge unit 15 is equalized with the time for the ink on the sheet S to dry. Therefore, a printing operation is not delayed more than necessary. It is possible to realize improvement of printing speed compared with the image forming apparatus in the past. In the example explained in this embodiment, printing is applied to one side of the sheet S. However, the present invention is also useful in applying printing to both sides of the sheet S.

In this case, the image forming apparatus 11 includes the moving mechanism 19 that moves the sensor in the width direction of the conveying path orthogonal to the conveying direction F in which the sheet S is conveyed. The sensor measures glossiness in the area H with high recording density on the sheet S. With this configuration, it is possible to calculate drying time for a portion on the sheet S that least easily dries. Therefore, it is possible to prevent the sheet S from being discharged to the paper discharge unit 15 while the ink insufficiently dries and smearing other sheets.

An image forming apparatus according to a second embodiment of the present invention is explained with reference to FIG. 5. An image forming apparatus 31 according to the second embodiment is different from the image forming apparatus 11 according to the first embodiment in the number of inkjet heads 32. Otherwise, the image forming apparatus 31 is the same as the image forming apparatus 11. Therefore, components different from those of the image forming apparatus 11 are mainly explained. The same components are denoted by the same reference numerals and signs and explanation of the components is omitted.

Figure 5:
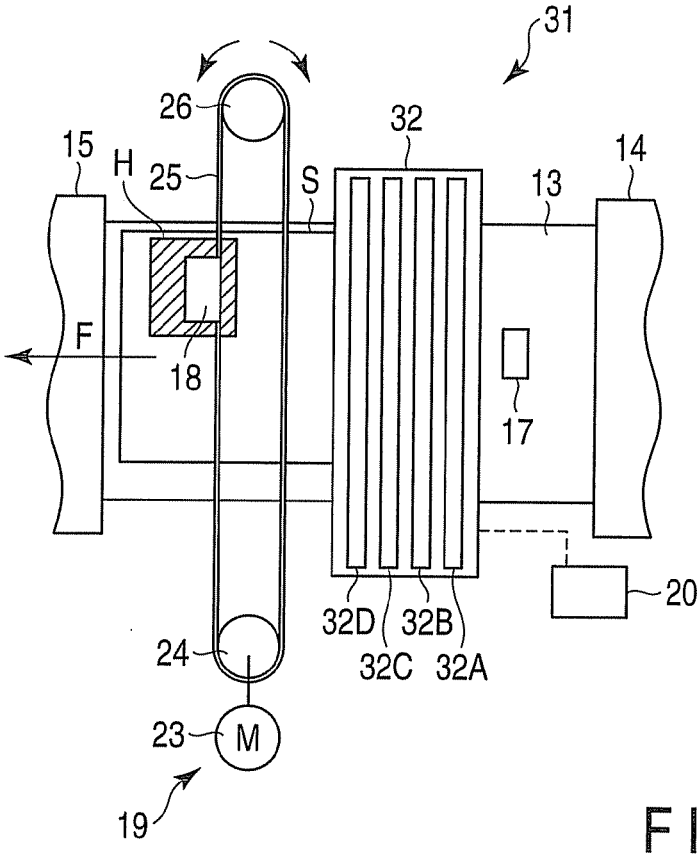
FIG. 5 is a schematic top view showing an image forming apparatus according to a second embodiment of the present invention.

As shown in FIG. 5, the image forming apparatus 31 is applicable to full-color printing and includes four inkjet heads 32. The four inkjet heads 32 includes, in order from an upstream side in a conveying direction of a sheet, a first inkjet head 32A corresponding to cyan, a second inkjet head 32B corresponding to magenta, a third inkjet head 32C corresponding to yellow, and a fourth inkjet head 32D corresponding to black. The four inkjet heads 32 are arranged side by side along the conveying direction F in which the sheet S is conveyed. Each of the inkjet heads 32 is a line head extending over the entire width direction of the conveying path 13.

Respective steps in forming an image on a sheet in the image forming apparatus 31 according to the second embodiment are explained with reference to FIG. 5. First, before an image is formed on the sheet S, which is conveyed by the conveying mechanism 16, by the inkjet heads 32, the glossiness of the sheet S is measured by the first sensor 17. The glossiness measured by the first sensor 17 is set as a reference value, i.e., a baseline, in measuring glossiness with the following second sensor 18. Subsequently, when the sheet S is conveyed to positions opposed to the four inkjet heads 32, inks are ejected onto the sheet S from the four inkjet heads 32. Consequently, images are formed on the sheet S.

When the sheet S is conveyed to a position opposed to the second sensor 18, the control mechanism 20 drives the moving mechanism 19 to move the second sensor 18 in synchronization with the conveyance of the sheet S. The moving mechanism 19 moves the second sensor 18 to an area with high recording density (printing ratio) on the sheet S with the driving force of the stepping motor 23. The second sensor 18 moves to an area H with highest recording density in the image formed by the fourth inkjet head 32D present in a most downstream position. The second sensor 18 measures glossiness in this portion on the sheet S. Thereafter, the control mechanism 20 calculates time for the sheet S to dry using the same calculation as the first embodiment.

The control mechanism 20 controls sheet conveying speed of the conveying mechanism 16 to equalize time until the sheet S reaches the paper discharge unit 15 from the inkjet head 32 with time until the ink ejected from the fourth inkjet head 32D completely dries. Therefore, even when the sheet S is placed over other sheets in the paper discharge unit 15, the other sheets are prevented from being smeared by the inks of the sheet S.

According to the second embodiment, plural liquid ejecting heads are arranged side by side along the conveying direction F in which the sheet S is conveyed. A sensor measures glossiness in an area with high recording density in an image formed by the liquid ejecting head arranged in a most downstream position in the conveying direction F.

With this configuration, it is possible to measure glossiness concerning an image printed last. Consequently, it is possible to secure sufficient drying time for a portion in which drying time is short compared with other portions because the portion is printed last. Consequently, it is possible to prevent the sheet S from being discharged to the paper discharge unit 15 while the sheet S does not dry and smearing other sheets. Since glossiness is measured in the area H with high recording density in the image printed last, it is possible to measure glossiness for a portion that less easily dries in the image printed last.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a conveying path that continues to a paper feeding unit and a paper discharge unit for a sheet;

a conveying mechanism that conveys the sheet along the conveying path;

plural liquid ejecting heads that eject liquid onto the sheet conveyed on the conveying path;

a sensor that is provided in a position between the plural liquid ejecting heads and the paper discharge unit and measures glossiness of the sheet on which the liquid is ejected; and a control mechanism that compares glossiness of the sheet immediately after the liquid is ejected and the glossiness measured by the sensor to calculate drying time of the liquid and controls conveying speed of the conveying mechanism to equalize conveying time for the sheet from the plural liquid ejecting heads to the paper discharge unit with the drying time.

2. The apparatus according to claim 1, further comprising a moving mechanism that moves the sensor in a width direction of the conveying path orthogonal to a conveying direction in which the sheet is conveyed, wherein the sensor measures glossiness in an area with high recording density on the sheet.

3. The apparatus according to claim 2, wherein the plural liquid ejecting heads are arranged side by side along the conveying direction in which the sheet is conveyed, and the sensor measures glossiness in an area with high recording density in an image formed by the liquid ejecting head arranged in a most downstream position in the conveying direction.

4. The apparatus according to claim 3, wherein glossiness of the sheet immediately after the liquid is ejected is measured for each of types of the sheet in advance, and the control mechanism stores the glossiness of the sheet immediately after the liquid is ejected, which is measured in advance.

5. The apparatus according to claim 4, wherein the control mechanism predicts time for ink on the sheet to dry.

6. The apparatus according to claim 2, wherein the control mechanism acquires in advance information concerning recording density from information concerning an image formed on the sheet and recognizes the area with high recording density.

7. The apparatus according to claim 6, wherein glossiness of the sheet immediately after the liquid is ejected is measured for each of types of the sheet in advance, and the control mechanism stores the glossiness of the sheet immediately after the liquid is ejected, which is measured in advance.

8. The apparatus according to claim 7, wherein the control mechanism predicts time for ink on the sheet to dry.

9. An image forming apparatus comprising:

a conveying path that continues to a paper feeding unit and a paper discharge unit for a sheet;

a conveying unit that conveys the sheet along the conveying path;

plural liquid ejecting units that eject liquid onto the sheet conveyed on the conveying path;

a measuring unit that is provided in a position between the plural liquid ejecting units and the paper discharge unit and measures glossiness of the sheet on which the liquid is ejected; and a control unit that compares glossiness of the sheet immediately after the liquid is ejected and the glossiness measured by the measuring unit to calculate drying time of the liquid and controls conveying speed of the conveying unit to equalize conveying time for the sheet from the plural liquid ejecting units to the paper discharge unit with the drying time.

10. The apparatus according to claim 9, further comprising a moving unit that moves the measuring unit in a width direction of the conveying path orthogonal to a conveying direction in which the sheet is conveyed, wherein the measuring unit measures glossiness in an area with high recording density on the sheet.

11. The apparatus according to claim 10, wherein the plural liquid ejecting units are arranged side by side along the conveying direction in which the sheet is conveyed, and the measuring unit measures glossiness in an area with high recording density in an image formed by the liquid ejecting unit arranged in a most downstream position in the conveying direction.

12. The apparatus according to claim 11, wherein glossiness of the sheet immediately after the liquid is ejected is measured for each of types of the sheet in advance, and the control unit stores the glossiness of the sheet immediately after the liquid is ejected, which is measured in advance.

13. The apparatus according to claim 12, wherein the control unit predicts time for ink on the sheet to dry.

14. The apparatus according to claim 10, wherein the control unit acquires in advance information concerning recording density from information concerning an image formed on the sheet and recognizes the area with high recording density.

15. The apparatus according to claim 14, wherein glossiness of the sheet immediately after the liquid is ejected is measured for each of types of the sheet in advance, and the control unit stores the glossiness of the sheet immediately after the liquid is ejected, which is measured in advance.

16. The apparatus according to claim 15, wherein the control unit predicts time for ink on the sheet to dry.

17. A printing control method comprising:

ejecting liquid onto a sheet using plural liquid ejecting units;

conveying the sheet, on which the liquid is ejected, to a paper discharge unit using a conveying unit;

measuring glossiness of the sheet conveyed by the conveying unit using a measuring unit; and comparing the measured glossiness and the glossiness of the sheet immediately after the liquid is ejected to calculate drying time of the liquid and controlling the conveying unit using a control unit to equalize conveying time for the sheet from the liquid ejecting unit to the paper discharge unit with the drying time.

18. The method according to claim 17, further comprising measuring glossiness in an area with high recording density on the sheet.

19. The method according to claim 18, further comprising measuring glossiness in an area with high recording density in an image formed by the liquid ejecting unit arranged in a most downstream position in a conveying direction in which the sheet is conveyed among the plural liquid ejecting units.

20. The method according to claim 18, further comprising acquiring in advance information concerning recording density from information concerning an image formed on the sheet and recognizing the area with high recording density.

* * * * *